US005736940A

United States Patent [19]

Burgener

[11] Patent Number: 5,736,940

[45] Date of Patent: Apr. 7, 1998

[54] PORTABLE TRANSIT DATA INFORMATION SYSTEM AND APPARATUS

[76] Inventor: E. C. Burgener, 55 Gibraltor Bay, Winnipeg, Canada

[21] Appl. No.: 593,294

[22] Filed: Jan. 29, 1996

Related U.S. Application Data

[63] Continuation of Ser. No. 305,357, Sep. 13, 1994, abandoned, which is a continuation-in-part of Ser. No. 124,973, Sep. 21, 1993, abandoned.

[30] Foreign Application Priority Data

Apr. 6, 1993 [CA] Canada ..... 2093457

[51] Int. Cl.[6] ..... G08G 1/123

[52] U.S. Cl. ..... 340/994; 340/991; 364/436

[58] Field of Search ..... 340/994, 996, 340/991, 992, 993, 989, 988; 379/58, 59; 364/436

[56] References Cited

U.S. PATENT DOCUMENTS

| | | | |
|---|---|---|---|
| 4,107,689 | 8/1978 | Jellinek | 340/991 |
| 4,350,969 | 9/1982 | Greer | 340/994 |
| 4,713,661 | 12/1987 | Boone et al. | 340/994 |
| 4,799,162 | 1/1989 | Shinkawa et al. | 340/994 |
| 5,021,780 | 6/1991 | Fabiano et al. | 340/994 |
| 5,483,234 | 1/1996 | Carreel et al. | 340/994 |
| 5,493,295 | 2/1996 | Lewiner et al. | 340/994 |
| 5,519,621 | 5/1996 | Wortham | 340/989 |

FOREIGN PATENT DOCUMENTS

| | | | |
|---|---|---|---|
| 2559930 | 8/1985 | France | 340/994 |
| 0288400 | 11/1988 | Japan | 340/994 |
| 9313510 | 7/1993 | WIPO | 340/994 |
| 9402922 | 2/1994 | WIPO | 340/994 |
| 9402923 | 2/1994 | WIPO | 340/994 |

*Primary Examiner*—Brent A. Swarthout
*Attorney, Agent, or Firm*—Kent & Edgar

[57] ABSTRACT

Provides users with an accessible continuously updated arrival time estimate of the next vehicle arriving at vehicle stops such as bus stops. Three discrete data streams are collected at a central computer and radio-beamed to portable receivers, each of which places some of the data in memory and uses some for real-time display, when the unit has been activated by the user. One stream allows time estimate to be computed; a second updates route changes; a third places messages such as cross-street data into unit memory, or displays storm warnings or the like. Users can enter specific stops and routes, can program audible pre-alert arrival warnings, can choose to be alerted to specific vehicle types (such as handicap accessible), and can see two arrival time estimates simultaneously, either for two different stops of different routes (to compute transfers) or of two sequential vehicles arriving at the same stop. The user's pre-paid fare status can be displayed for drivers, and users can enter an ad-hoc stop on an unfamiliar trip and read the distance and arrival information of the return stop on the other side of the street.

17 Claims, 5 Drawing Sheets

PORTABLE TRANSIT DATA INFORMATION SYSTEM AND APPARATUS

RELATED APPLICATION

This is a continuation of Ser. No. 08/305,357, filed Sep. 13, 1994, which is a continuation-in-part of Ser. No. 08/124,973, filed Sep. 21, 1993, both now abandoned.

BACKGROUND OF THE INVENTION

This invention relates to alert and monitoring systems for urban transit fleets, and particularly to providing passengers with continuous access to real time-to-arrival estimates to any stop of interest on any route of interest, using a personal portable radio receiver.

Transportation systems such as urban bus systems have for years operated on the basis of schedules, and indeed, many Automatic Vehicle Location (AVL) systems have been installed to help maintain the buses on schedule. Yet the reality from the passengers' point of view is that buses still will run early or late, depending upon traffic, or the mood of the operator. If the passenger were to miss the bus if it is early, the passenger would often wait 20 to 30 minutes. To reduce the risk of missing the bus, passengers arrive 5 to 10 minutes early. This can be a very unpleasant experience, if the weather is extremely cold, or if the wait occurs in an undesirable area. From another point of view, students would like to appear sophisticated to their peers, hence the curbside wait is very undesirable; especially when friends drive by in a car. As a result, passengers are abandoning transit in favor of the automobile, as soon as their economic circumstances permit. The result is declining transit ridership, increased automobile congestion, increased urban pollution, and less livable cities.

The present invention provides a significant quality improvement to transit, by making access more convenient, which can be expected to result in increased ridership.

DESCRIPTION OF THE PRIOR ART

An approach to providing transit arrival time information in the urban environment but still with a very limited usefullness relative to the invention that will be disclosed, is to have an information display providing time of arrival readouts at bus stops or at shopping malls where passengers gather. Frequent location updates are provided from the bus; U.S. Pat. No. 4,857,925, Brubaker; and Canadian patents #1,058,298, Guillot, and #993,076, Cottin, are of this type. None of these are particularly convenient, since the user needs to be at a stop or other central display to get information.

An alert system devised by Boone et al; described in U.S. Pat. No. 4,713,661 describes a home radio receiver or transportation monitor that receives signals directly from a bus on a rural bus route. This system provides a warning message when the bus is at the pre-selected stop prior to the stop of interest, while the passenger is in their home, which is helpful, but it does not otherwise provide information. This means that the passenger cannot determine how long the bus will be before arriving, unless it happens to be exactly at the stop selected as the first alert stop. In an urban environment, this prevents ad-hoc trip taking, where decisions are made on the spur of the moment. If monitors were provided outside the home, such as at a school, the lack of continuous information would prevent quick planning, such as when the passenger desires to do a small errand, then go and catch transit.

An alert system described by Greer, U.S. Pat. No. 4,350,969, provides a radio output of position indication codes from each bus on a rural bus route. The user must know the bus identification code to selectively monitor the bus position on the route. In an urban environment, the passenger would not be able to identify each bus on a route. Further, when away from a familiar location, the position codes offered cannot be related to the stop of interest to the passenger, since the passenger does not know how far along the route that the stop location is.

A vehicle monitoring system by Williamson et al, International Publication No. WO 93/13510, relates to a passenger information bus arrival system with passenger information displays at each bus stop. The scheduled arrival times can be altered to reflect the real time running delay, which is obtained from the bus on the system and broadcast to a multiplicity of bus stop receivers. This system works best for a customer that is at the stop and desires to know the arrival time of the next arriving bus. This system does not provide this information by broadcast to receivers remote from the bus stop. Passengers must still use traditional methods such as schedules to access the transit system, and must risk exposure to inclement weather while waiting for the bus. While it is advantageous to be aware of the bus arrival time while at the stop, no advantage is provided for ad-hoc trip planning, or reduction of unnecessary waiting while at the bus stop.

Mr Okamoto in Int. Cl. G08G1 12, HG4B7/26, describes a similar vehicle monitoring system to Williamson, with the difference that the bus radios its distance-inferring pulse count to a central control center, as opposed to the next stop, for relay to the central control center. The limitations of this system from the passenger's point of view are the same as for the system described by Mr. Williamson.

Shinkawa et al, U.S. Pat. No. 4,799,162, describes a vehicle monitoring system similar to Mr. Okamoto, with the difference that the central control center processing unit provides complex computations designed to make the arrival time information as accurate as possible for display at the bus stops along the route. The limitations of this system from the passenger's point of view are the same as the system described by Mr. Williamson.

The present invention overcomes the disadvantages of the prior art by providing a transportation vehicle monitoring system that works in an urban environment with a multiplicity of routes and vehicles, is portable, operates very close to real-time, and can provide passengers with access to transit information while in the home en-route to the stop, on the bus, or at work. The system that provides this information makes use of AVL systems that are already in use in many urban transit fleets. The vehicle location information on each route obtained from the AVL system is centrally processed and formatted for the radio broadcast covering the urban area served by the transit fleet.

The invention specifics a coordinated system in which AVL bus location data is passed from the AVL control system to a transit central Computer, and a radio broadcast transmitter provides 3 data streams from the computer to the receiver: (1) a positional LOCATION data stream (relatively continuously beamed); (2) a ROUTE data stream, (updating at least daily); and (3) a DISPLAY information data stream on an as-required basis for storm warnings, and at least daily to provide messages and applicable cross street display information for each stop.

Transit passengers will possess a portable radio receiver that allows passenger to input and store bus stop numbers and routes of interest to them. When activated, each radio receiver decodes a radio broadcast of continuously updated transit vehicle location information, allowing the receiver to calculate and display real time-to-arrival estimates of the next one or two buses to the selected stop, as well as other information of use and interest, such as weather information, vehicle handi-capability, personal messages, and others.

An object of the present invention is to disclose an apparatus that provides transit users with continuously updated arrival time estimates of next vehicle arrivals at specific vehicle stops on routes having a multiplicity of vehicles on them. The apparatus includes: data interface to an Automatic Vehicle Location (AVL) system that provides real-time vehicle location data of each transit vehicle on each route at least once each 1½ minutes to a Transit Central Computer (TCC); a TCC that maintains in its computer programs real-time location information on each transit vehicle, and as well maintains route information, time information, and weather information; one or more radio broadcast towers; and a multiplicity of portable radio receivers comprising visual readout, user input means, and computer memory and programs; whereby (a) the TCC processes the location, route, time, and weather information into radio broadcast data files, and forwards the files to a radio broadcast lower that broadcasts the files to the receivers; and (b) the receivers then compute and display selected information, thus providing users with a visual readout of a time-to-arrival estimate counted down to zero, and corrected as new locational data is received by radio.

It is also an object to provide an improved method of disseminating urban transit information relating to routes with a multiplicity of vehicles on them, utilizing essentially the apparatus just described, and in which: the TCC maintains a plurality of information files, herein called route files, concerning vehicle routes and schedules and users; the AVL collects vehicle location information, herein called location files; the TCC reads said location files from the AVL by means of the computer interface and combines location files with route files into three discrete data streams; the three data streams are processed into radio broadcast data files, and forwarded to broadcast tower(s) by means of a communications interface. The three streams comprise: (i) a vehicle location file, containing primarily vehicle location information, and transmitted frequently, such as every 10 seconds; (it), a route information file, containing primarily route information including stop numbers, route numbers, cross-streets, and route symmetry, and transmitted daily and maintained by the receivers in memory until updated: and (iii), a display information file, containing diverse information including weather information and warnings, personal messages, date and time, cross-street names, receiver identification, and fare validity, and transmitted daily and more often as needed. In this method the receivers receive and compute the three broadcast data files; and the receivers display information according to requests by users through the user input means.

It is a further object to provide for such a method in which the route files comprise at least information files on: route stop numbers; route inter-stop distances; average inter-stop vehicle speeds; average weather; vehicle handicap status; vehicle loading; route symmetry; special entry of vehicles into route; special removal of vehicles from route; percentage slower than average speed; weather warnings, personal messages, date and time, cross-street names, receiver identification, and fare validity. The information requested by users and displayed on the receivers may include: stop numbers; stop opposite for return transit trip: 'fare valid' message; cross-street names; personal messages; and handicap status of transit vehicles. Further, a programmable beeper alert can be user-set to warn users of vehicles approaching specified stops and times. Display, location, and route files may each be transmitted as a series of discrete records in 16-bit bytes using known computer coding techniques. The portable receivers may comprise: decoding means appropriate to decode location, route, and display files; computer memory means to store files; computer program means to compute and display the files; visual display means to display the results of these computations, including a first 18-character visual readout and a second 18-character visual readout; a programmable beeper alert; and user input means such as keys.

BRIEF DESCRIPTION OF THE DRAWINGS

For this description, refer to the following diagrams, wherein like numerals refer to like parts.

DETAILED DESCRIPTION OF THE DRAWINGS

Figure 1:
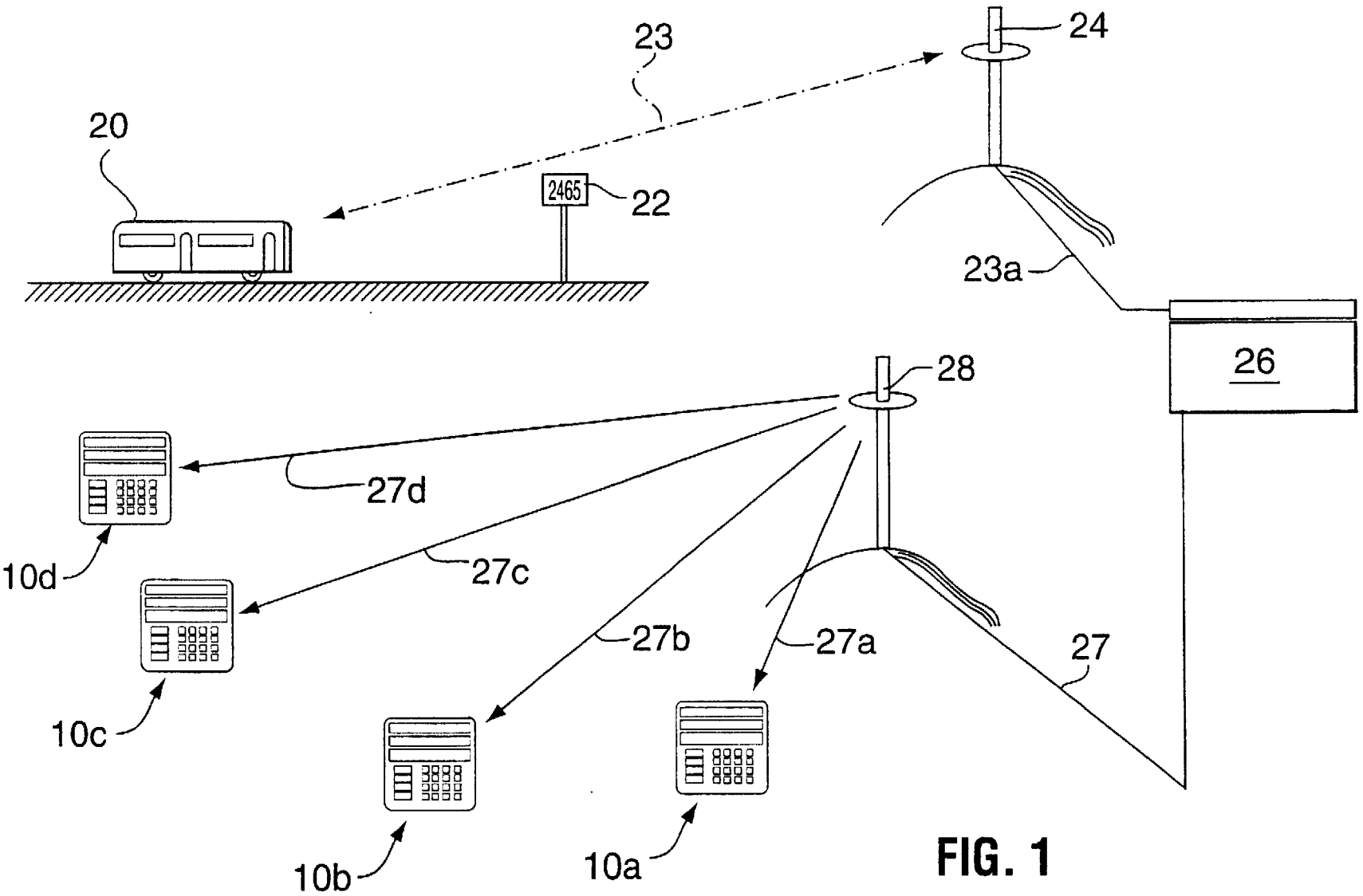
FIG. 1, the invented transit data system, integrated schematic and perspective view.

A schematic overview of the system is provided in FIG. 1, where can be seen bus 20, bus stop 21, Automatic Vehicle Location (AVL) system radio transmission 22 to receiving tower 23, land line 24, AVL control center 25, AVL to Transit Central Computer (TCC) interface 26, TCC 27, land line of broadcast encoded data streams 28, broadcast radio tower 29, broadcast encoded data streams 30*a*, 30*b*, 30*c*, 30*d*, and corresponding portable receivers 10*a*, 10*b*, 10*c*, 10*d*.

Figure 4:
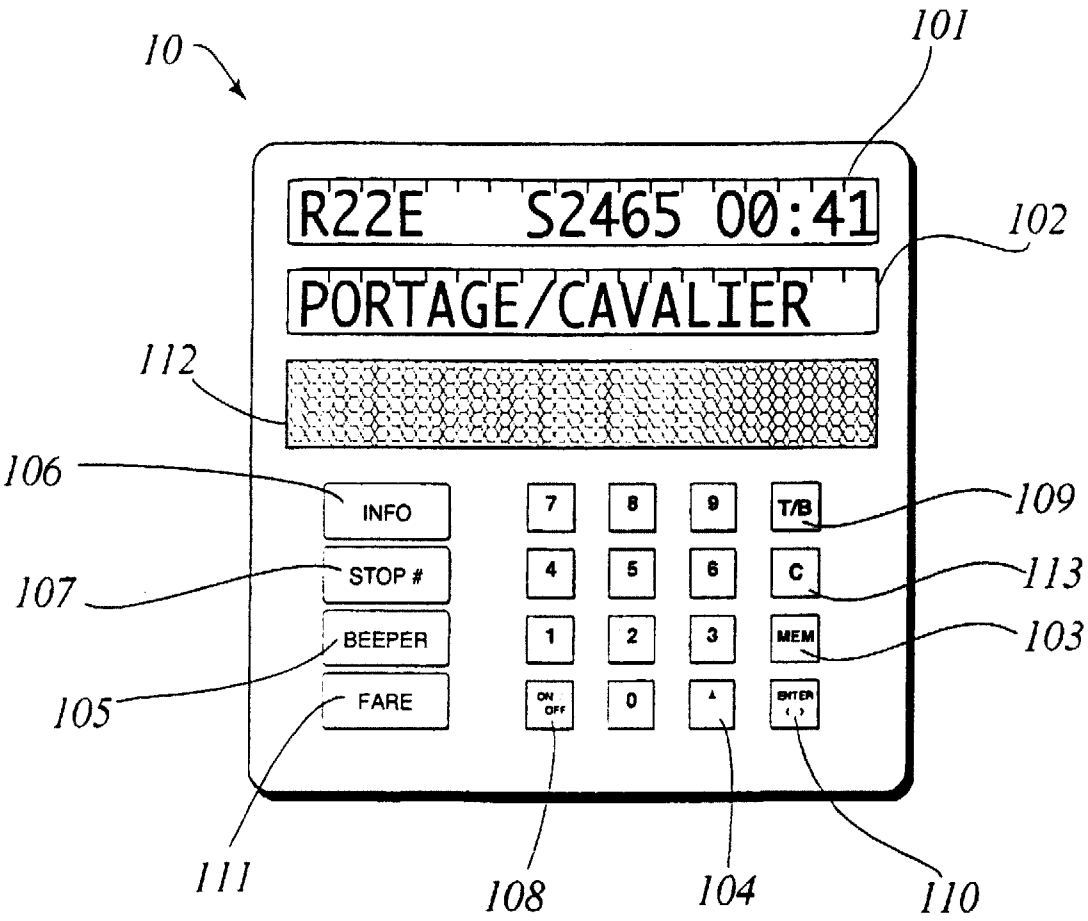
FIG. 4, an example of a portable receiver in the invented transit system; front elevation views.

The preferred apparatus to embody the system includes a portable receiver such as generally indicated as 10 in FIG. 4, which is a modification of an existing FM sub-carrier radio receiver, or design used by The Data Broadcasting Corporation™, incorporating a microprocessor, standard electrically erasable programmable read only memory (EEPROM), and static random access memory (RAM). The unit is modified with keys 103, 104, and so forth, for inputs, and displays 101 and 102 for outputs. The current receiver design handles data in byte format, or bit strings, with files of variable length, and includes error correction, and data encryption, with an effective data throughput rate of 9600 bits per second. Other data broadcast systems, such as paging systems, or the FM subcarrier RDAS system, that have lower effective data throughput rates are equally candidate systems to provide the transit data system broadcast and portable receiver devices for small cities.

The most significant information displayed by each portable receiver is a time-to-arrival estimate of the next one vehicle or two vehicles (buses, trains, subways etc.) to the specific stop of interest to the passenger. However, other useful information is carried in the system, including other stops or intrest; cross-street names; handi-capable vehicles; proof or fare payment, and so on. These and others will be explained below, after an introduction detailing the AVL system used to provide location data.

AVL systems that can provide position information of at least once every 1 and ½ minutes about bus 20 in FIG. 1 is provided by other technologies. Some AVL systems, such as is used on Toronto transit, locate vehicles each 6 seconds, while most obtain positional fixes each 60 seconds. The positional information exists in various forms, depending upon the design or the AVL system. The most common is a radio transmitted data count of odometer clicks or wheel rotations since the last radio signpost on the route. This method is commonly called the "signpost" method of vehicle location, and has been in existence since the early 1970's. More recent technologies use the satellite Global Positioning System; another rises radio ranging techniques to locate the bus position. For all systems, a radio poll to bus 20 is broadcast from radio lower 23, causing the vehicle ID, and number of wheel rotations or position fix, along with status information bits, to be radioed from a bus such as 20 to a lower such as 23, or other radio receive site (not shown). A land line 24 is most commonly used to transport the data to an AVL System Control Center 25 such as illustrated in FIG 1. A computer interface 26 moves data to the TCC 27.

Figure 2:
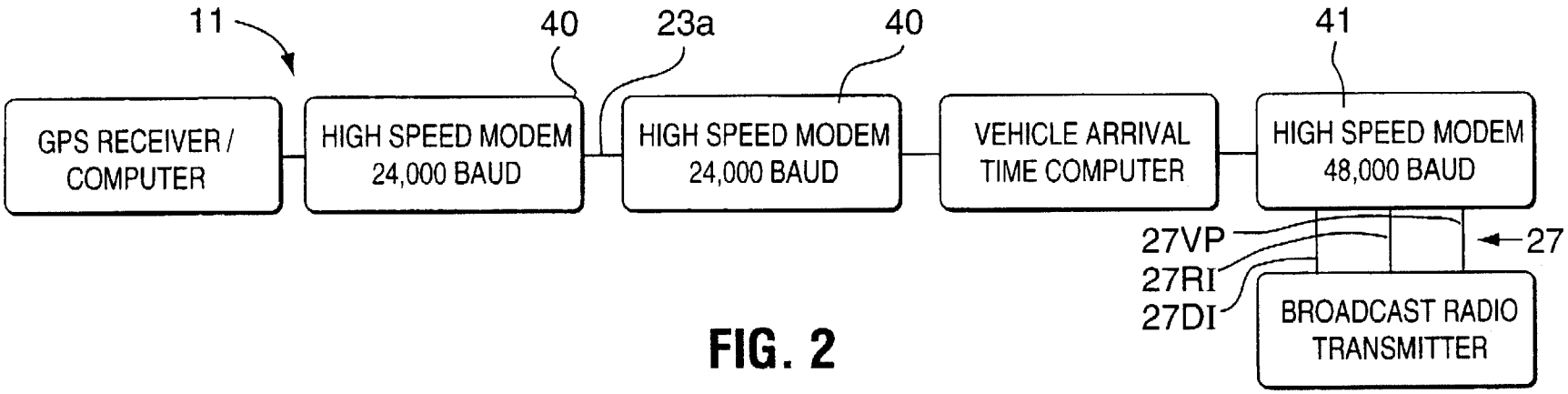
FIG. 2, the invented transit data system, data flow block diagram.
Figure 2A:
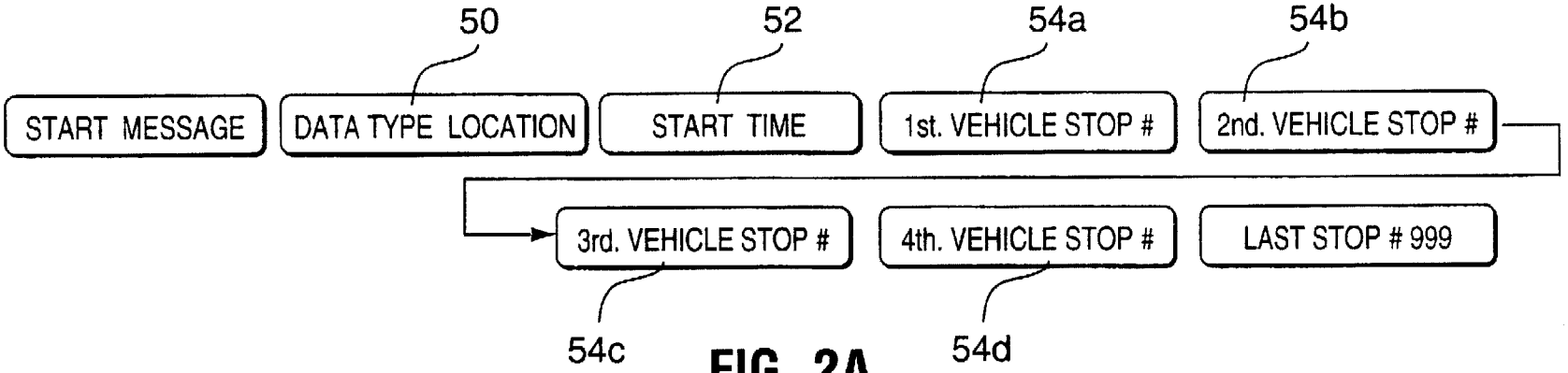
Figure 2B:
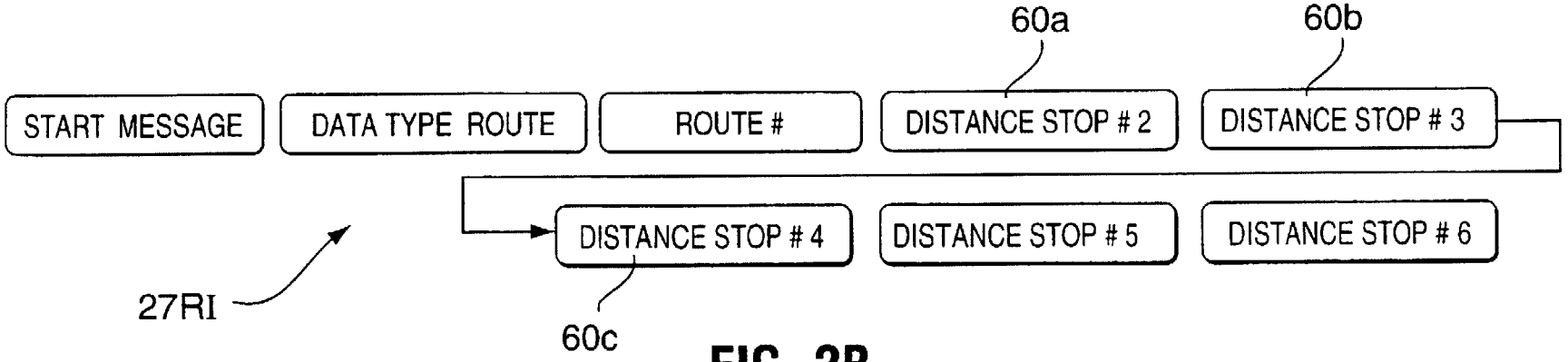
Figure 2C:
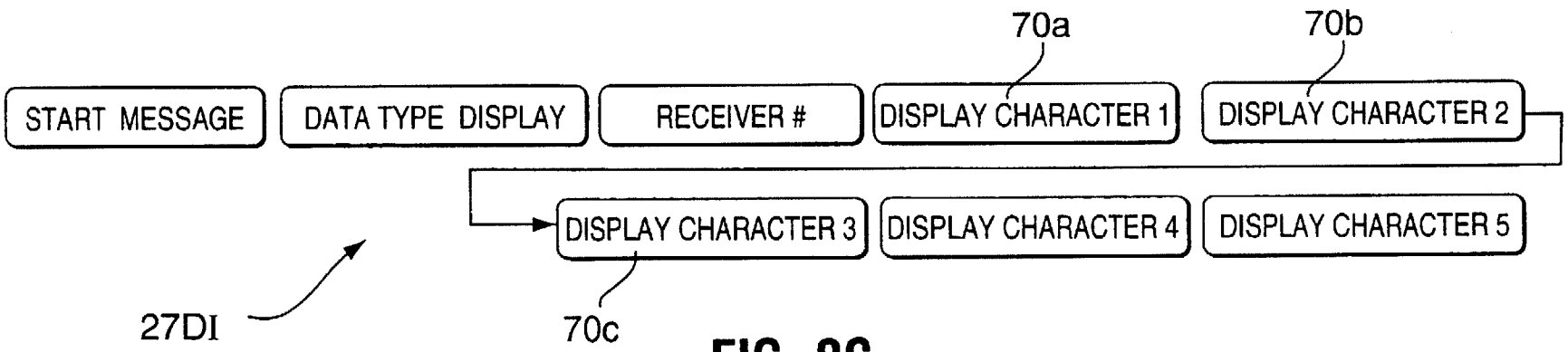

The TCC 27 accepts data input in a specific format suitable to each AVL system, and maintains files of routes, active vehicles, vehicle positions, current route data, current advisory data, and a system clock. This computer has control programs to format vehicle location information, route description information and display information. Block diagram FIG. 2 shows an embodiment of data flow from AVL Receiver/Computer 25, via computer interface 26, to TCC 27; and thereafter to a communications interface 28, such as a high speed land line with modems of at least 19,200 bits per second. By this time, after processing in the TCC 28, three discrete data streams are carried; the first on Vehicle Location, 28VL, the second on Route Information, 28RI, and the third on Display Information 28DI. These are carried to the broadcast radio lower 29, and broadcast to portable receivers 30. The TCC executes a transmission of Vehicle Location Files, 28VL, as often as each 10 seconds, to be broadcast to all of the portable radio receivers in the broadcast area; and executes a transmission of RI files, 28RI, at least once each 24 hours, reflected in changes in the stored route files in each portable receiver. Display Information files, 28DI, are broadcast daily and more often in special circumstances, such as for storm warnings.

The contents of these three types of files will now he discussed in more detail; followed by a description of user functions incorporating the data provided by these files.

1. Vehicle Location:

Each transit vehicle's location is its current estimated location along its route, described in relation to the transit stop that it has just passed, The TCC's control program stores the AVL position information on each bus, the time of the position fix, and computes the estimated position of each bus at the time of the location estimate to be broadcast to the receivers. The Transit Central Computer's program compares the average travel speed of each bus in relation to its expected travel speed over the previous 10 minutes, and formats a Vehicle Location (VL) File, a portion of which is shown in FIG. 3, for each bus route.

Figure 3:
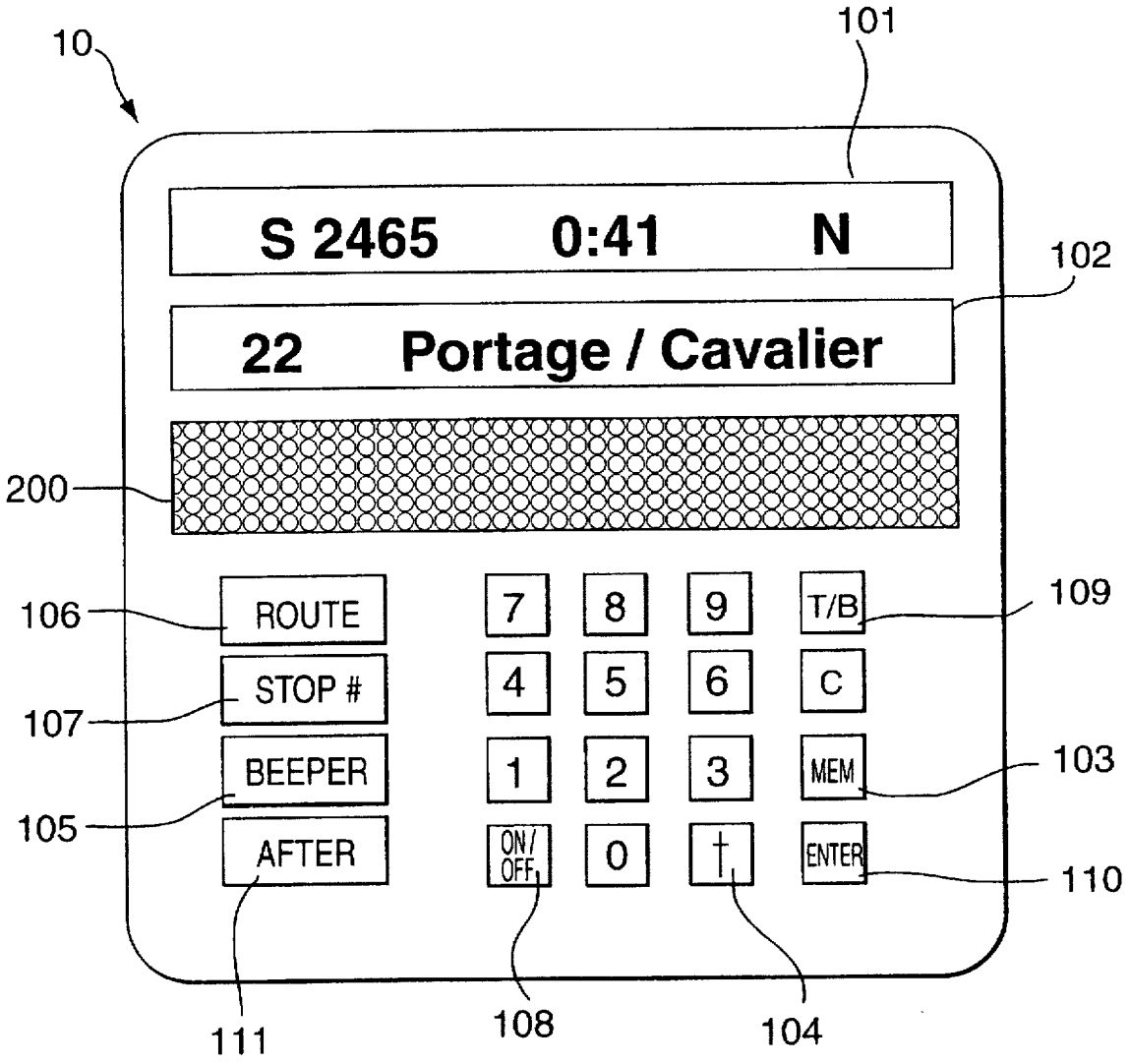
FIG. 3, selected 16-bit vehicle location files transmitted from the Transit Central Computer in the invented system; schematic.

The sequence of data records in the VL File, FIG. 3, actually starts with a Start Header record, generally indicated as SH in FIG. 3, with which the radio broadcast system software formats and codes and decodes the header information and error correction, needed to start the communication of the file. The first 16 bit content record of the VL file is the file type and time record, generally indicated as TT. Bits 1 to 4. bracketed as $TT_a$, identify this file as being a LOCATION file. The portable receiver's control programs now switch to their decoding routing appropriate for decoding LOCATION records. The second content record, generally indicated as RID, identifies the route sequence I.D. number. The next four records, generally indicated as $VLS_1$, $VLS_2$, $VLS_3$, and VLSS, respectively, are identified by binary data (in bits 15 and 16; not indicated on FIG. 3) as being special records. For instance, any of them may be further indicated as a staff/stop record used to show the start of transit vehicles on a route using a scheduled time, or to show exit of vehicles from a route, at any point on a route. The first three vehicles on a VL file will always be scheduled vehicles, if there are any, using scheduled departure times. These records represent the third earliest vehicle start, the second earliest start, and the first earliest start, in records $VLS_1$, $VLS_2$, $VLS_3$, respectively. These three vehicles are not yet on their routes, and their start times are calculated by adding the offset time in minutes located in bits 1 to 10, bracketed as $VLS_{1a}$, to the time of location estimate, found in bits 5 to 16 of record TT, and bracketed as $TT_b$. If the vehicle is running late, say it is behind on the return run on the same route, then the TCC will set back the scheduled departure time by the number of minutes running late.

Following this the already on-the-route vehicles are encoded, starting with record generally indicated as $OL_1$ in FIG. 3. This location data record includes the estimated position of the vehicle on the route, bits 1 to 7, bracketed as $OL_{1a}$, with a relative count of stops passed since the previous vehicle along the route. If the value of the sequence number count of stops passed exceeds 128, then a Stop Sequence increment record, such as is generally indicated as VLSS, is inserted into the data stream.

The percentage distance travelled between stops is located in bits 8 to 11 of location records $OL_1$, $OL_2$, $OL_3$, and so forth (only 3 records arc shown in FIG. 3); these bits are bracketed as $OL_{1b}$, $OL_{2b}$, and $OL_{3b}$ in FIG. 3. As new AVL scans are made, the estimated position is corrected by the TCC, and each portable receiver receiving the information updates its RAM memory.

In the same manner as just described and illustrated by the records shown in FIG. 3, 16-bit records are transmitted for all the information to be described below; these are not shown diagrammatically herein, since, in schematic form, they would be almost identical to the the foregoing.

Some transit vehicles will run slower than usual, rarely do vehicles run significantly faster: If the actual travel speeds computed for a vehicle over the previous 10 minutes along a route are more than 10% slower than average, then the speed factor is coded in a record showing ">10% slow ;" and it would be ">20% slow" for more than 20% slower than average. Each passenger would use this information to help them time their arrival at their stop, realizing that unless it is a heavy rush hour demand or a snowstorm causing the slowdown, the bus or train could regain its expected average speed at any time, as conditions permit.

Some transit buses are removed from a route on a scheduled basis, before the bus has completed the route. The passengers looking at their receivers further down the route will not see any reference to this bus, because a special record is inserted into the location data stream. Receivers that are calculating the times-to-arrival of buses to a stop further down the route than the exit point designated will jump over the bus location information. If buses are removed on an ad-hoc or emergency basis, such as to help out on another route, the bus must then unload its passengers at a convenient stop and be reassigned. This process is called "short running" a bus, and is not a practice that passengers like to have happen to them, but it does occasionally happen. The short-run bus would drop out of the currently active list of buses for this route in the TCC, and the portable receivers in use by passengers further down the route would note the shift in the time-to-arrival of the next vehicle.

Similarly, some vehicles are added to a route mid-way, on a scheduled basis. A special record gives the start position. The portable receivers used by passengers interested in arrival times further down the route would then have this vehicle displayed if it was either the first or second bus due to arrive at their stop of interest. If buses are added on an ad-hoc basis, such as when major slowdowns or emergencies have occurred, then the bus just added would be added to the currently active list for the route in the TCC, and would be broadcast in the normal manner in the VL data stream for that route. The portable receivers being used by passengers on that route could see a sudden change to the estimated time-to-arrivals for either the first or second arriving units.

Some transit buses are handicapped or wheelchair capable. The TCC maintains a vehicle identification file for each vehicle in the transit fleet. Vehicles that are equipped to take wheelchairs are identified as handi-capable by a coding of a Vehicle Location record. Most transit systems will have fleets that are 100% Handi-capable before the year 2000. If the AVL system is capable of passing through to its central computer the number of occupied or unoccupied wheelchair spaces on the vehicle, then a vehicle that is fully loaded with wheelchairs can be designated as not handi-capable.

Some transit vehicles get overloaded with passengers. The Vehicle Location record contains a code to identify the load level, with different codes for a fully seated load and for a full standing load.

2. Route Information File:

The second discrete data stream transmitted by the TCC, Route Information (RI), similarly contains 16-bit data records, this time with the route specifications. These include the telephone exchange code: the telebus stop number; start-of-route timing; distance in meters to the next stop; average travel speed; and special characteristics records. The maximum distance between stops is binary 512 multiplied by 10, or 51.2 km. The minimum average speed that can be coded for the inter-stop distances by this particular code is 1 km/hr and the maximum is 128 km/hr.

Some cities may use two or three groups of telebus stop numbers, based upon different telephone exchanges, and blocks of up to 8224 possible stops. For example, telebus stop numbers 234-4556, 537-4556, 257-4556 represent three different telephone exchanges, 234, 537, and 257.

The Telebus stop number is labelled on each stop, and is often found in the back of the city telephone directory. If the city does not use Telebus, or if each stop is not uniquely numbered. Then a dedicated new numbering system will be used, to provide up to 16,448 stops. The stop numbers contained in each RI record are used by the portable receivers to determine the stop sequence number for each stop of interest to the passenger.

Start-of-route timing point is also contained in RI records. This is not a stop at which passengers board the vehicle, but the transit operator might start the route at this point and travel a short distance to get to the first passenger stop. The distance to the first stop is coded in the RI records.

The average speed between stops, which is contained in the RI records, is unique to that part of the route. Routes are normally designed to have a travel speed as specified by the transit scheduler. Consideration is given to winter driving speeds, and the average speeds specified by the scheduler may be slower in winter as compared to summer. Vehicle operators are required to maintain these speeds. The reality is that some sections of the route are routinely faster than the schedule, and some sections are routinely slower. However, with an AVL scan even each 1½ minutes, a 20% error at 35 km/hr only translates into an error of two city blocks, before the next AVL scan corrects the estimated time-to-arrival. Routine AVL data logging and post processing can allow the operator of the transit data system to improve upon the accuracy of the average speeds embedded in the RI records.

The RI File contains special records; for instance, a special record is used to define the start of the symmetric portion of a route, i.e., where the transit vehicle runs on both sides of the street. Each RI File will have at least one such special record. A route normally is fully symmetric; however some routes may have several symmetric portions, say a downtown one-way street system is symmetric for several sections but for other sections has significantly different path lengths. An appropriate special record is then manually generated for each symmetric portion, and is inserted following the original special record; and so on for as many symmetric portions as the route contains. The return RI File contains the identical records, with the start and stop of the symmetric portion(s) being in reverse order.

3. The Display Information File:

This file contains several unique file formats. These file formats are identified in the opening bits of a File Type Record. (As with the RI File explained above, the DI File 16-bit records are not shown diagrammatically, being also almost identical to those illustrated in FIG. 3, the examples of the Vehicle Location File records.)

The first DI file is the system file. It contains the key transit system specifications. It is the first file to be loaded when updating route information. This file has a list of all the routes. In route sequence number order, route numbers, the starting address of each route file in memory, the starting address of each return route file in memory, and the telephone exchange numbers.

The second DI file is a system clock file. It is used to provide a synchronization on dates and times for all portable receivers and other devices making use of the transit data broadcast.

The third DI file is the weather file. It contains the current weather and is used for supplying weather information. Each weather file consists of a month of forecast, day of forecast, and hour of forecast. The weather file is read into RAM memory of the receiver, including the month, day of month, and hour of day. If the newly received forecast has a date later than the previous forecast, the previous forecast is erased and the new forecast read into RAM.

The fourth DI file is a personal messaging file. The personal messaging file allows individual messages to be transferred to each portable receiver. It contains an individual address that is recognized by only one portable receiver; and also it contains a group address. The unique address allows an individual portable receiver to be identified in the broadcast area; and a group address allows a group of devices to receive a message—for example owned by a company and provided to its employees.

The fifth DI File is a cross-street file. If the portable receiver list of favorite used stops includes stops along this route, then the names of cross-streets nearest the favorite stops can be read from this file. (This will be detailed under User Functions, below).

The sixth DI file is a face payment file. The fare payment file is a special form of individual or group message.

Individual portable receivers can have an internal store of fare payment status altered by the transit radio broadcast, or groups of portable receivers can have their internal stores of fare payment status altered. The broadcast of the fare payment status is done through the TCC daily, and is contingent upon the passenger having prepaid for a monthly, bi-weekly, weekly, or day pass. The fare payment function enables the portable receiver 10 in FIG. 4 to blink the message "VALID FARE" in the top display 101, 3 times a second, whenever any key of the portable receiver 10 is depressed for one second or more continuously. The bottom display 102 will display the type of fare, and the date and time the fare is valid until.

User Functions:

In FIG. 4 an embodiment of the portable receiver 10 is shown; the top 18-character display, indicated as 101 on FIG. 4, reads "R22E" Route #22 Eastbound; "S2465" for stop number 2465; and "00:41" for the estimated time to arrival, zero minutes and forty one seconds. The lower 18 character display, 102, shows the cross street as "Portage/Cavalier." Photocell 112 supplements the battery store for the portable receiver.

The user makes a new stop entry by turning on the power of the portable receiver 10 by pressing the ON/OFF key, 108, followed by pressing the STOP# key, 107. The portable receiver 10 responds by asking the question "new stop? key <>" on the top display 101, and then "existing? key MEM" (these display words are not illustrated herein). If the enter <> key, 110, is pressed, then the portable receiver program starts a new stop entry routine. These types of routines are well known in computer interface, and in this case the user enters stop and telephone exchange numbers while following prompts on the display screens 101 and 102. As the user finishes and confirms that the portable receiver program has the correct route and stop, the portable receiver display 101 provides a time-to-arrival estimate such as the display visible in FIG. 4. The time required to provide the estimate is normally a fraction of a second. The portable receiver program was also running its radio receive routines as soon as the power "on" switch 108 was pressed, and since the entry for the new stop number usually takes more than 10 seconds, a complete store of vehicle locations normally would have been read into RAM and be ready for use.

A request is made of the passenger to store the new stop number in memory, using the bottom line of the display 102, while the top line 101 provides the countdown of the time-to-arrival of the next arriving transit unit. The original two entry display lines might appear as follows for the stop shown in FIG. 4.

"22E #2465 3:34"

"Note: MEM to save"

The passenger can request the times-to-arrival of the next two arriving units by pressing key "T/B", indicated as 109 in FIG. 4, the TOP/BOTTOM key. The bottom display line 102 will then present the information on the second arriving transit unit in the same formal as the top 18 character display line 101.

The passenger can request more information about the next arriving unit or units by pressing the INFO key 106 in FIG. 4. The bottom display 102 or both top display 101 and bottom 102, as appropriate, will flash: (for instance:) "SPEED>10% SLOW/WHEELCHAIR CAPABLE/FULL STANDING LOAD", in sequence, and then display(s) will revert back to its/their previous state. (Such information request is not shown on the diagrams).

A recall of a stop previously stored in RAM memory by the user can be recalled from the portable receiver 10, using the MEM key 103. The portable receiver program reads the memory store of routes and stops previously stored by the passenger, softs this list by beeper alert times, (which are explained below), and presents on the top display 101 the route and stop with the beeper alert time closest to the current time. The bottom display 102 presents the 18 cross-street characters stored in RAM for the stop, if previously available and stored from the radio broadcast of Route Information cross-street file. These 18 characters are read into RAM and stored with the route and stop file of favorite used stops. When the two line stop information is called to the two display lines, the 18 character cross street information is read from RAM and displayed on the bottom line to aid the passenger in quickly identifying the stop. The Route cross street files are broadcast by the transit TCC at least once a day. For instance, "Portage/Cavalier" is the closest cross-street to the stop S2465 on Route 22 East, as shown in the display 101 and 102 in FIG. 4.

By pressing the up arrow key 104, the route and stop with the next closest alert time to the current time is displayed in the top display 101. In this manner, the passenger can use the portable receiver's internal store of alert times with each route and stop of interest to organize the recall from memory of the routes and stops of interest to the passenger. This saves the excessive keying of the up arrow key 104, in order to recall previously stored stop information.

This time-to-arrival estimate is presented in the top display as soon as a radio update is available, usually within 10 seconds.

Route specifications, broadcast in the RI files records, are stored and updated in the portable receiver. The Route Information files are normally downloaded by radio broadcast during the quiet part of the day when buses or trains are not running, such as at 3:30 a.m. The normal practice is to place the portable receiver in an area of good radio reception to allow for the radio download, such as the home at night. The program in each portable receiver will check its version of the route information, and the date. If the RAM stored version is an old version, the receiver program updates to the newer version. This process is repeated for all of the routes in the city.

The RAM data stored on each route consists of the sequence number of the stop along the route that the vehicle has passed, the percentage travelled towards the next stop, whether or not the vehicle is handi-capable, whether it is running slow, and the time of the location estimate. Each route and stop of interest to the passenger has previously been entered into RAM memory, and consists of its stop number and stop sequence number counted from the start of the route. When requested for an estimate of time to arrival for a specific route and stop, the program identifies the current vehicle positions on that route that have stop sequence numbers smaller then the stop of interest. The calculation of the estimated time-to-arrival is made using the route inter-stop distances and average travel speeds stored in RAM memory. The calculations start with the three closest vehicles on the route, if available. If only two, one, or none are available on the route with sequence numbers smaller than the stop of interest, then the scheduled-to-start vehicles are used to provide the estimated times to arrival. This list of three estimated arrival times are stored in Ram, each attached to its corresponding routes and stops of interest.

The display program providing the countdown of the estimated time-to-arrival on the portable receiver screen can be toggled to jump between routes and stops of interest and the estimates will be instantly calculated from the stored information. If for some reason, such as poor radio reception, there are no impending arrivals stored, or if the stored data is out of date, i.e., all potential arriving units read 0:00, then the passenger will need to wait until new data is received, normally within 10 seconds.

If the city uses multiple telephone exchanges (say, three exchanges) the program in the each portable receiver will ask "which exchange?" "1=234,2=537,3=257". The passenger will enter 1, 2 or 3, as appropriate. If the city uses only one exchange, the passenger is not prompted for the exchange prefix.

A passenger can request the "stop opposite" number without having to cross the street, by entering the stop number at the stop at which the passenger has just alighted. This request is made of the portable receiver 10 in FIG. 4 by keying rapidly twice on the Stop# key, 107. The portable receiver program responds with "enter current stop for stop opposite". When the portable receiver program is requested for a stop opposite, it first determines if the current stop has a stop sequence number within a symmetric portion of the route. If the route is symmetric, the portable receiver then provides the stop number of the closet stop opposite to the current stop number, along with a distance in the lower display, "200 m. ahead", or "200 m. back". The passenger then has an indication that the stop opposite is 200 meters ahead on the route or 200 meters back on the route. The passenger then presses <enter> key 110 to store the route and stop in RAM. The passenger then can time their walking time to the stop opposite, and use the portable receiver's estimated time-to-arrival display to time their access to the return transit trip.

The passenger can request an audible beeper alert, key 105 in FIG. 4, of an impending arrival. The routine will not be completely detailed here, but in brief the passenger is asked for the number of minutes advanced warning required of the impending arrival of the transit unit at each route and stop specified. Up to 99 minutes warning is available; the information is saved in memory. The passenger is required to have the portable receiver turned on, the stop and route of choice displayed, i.e., selected, and the beeper request in the ON state, in order to have the beeper sound at at the desired time. In this manner, all the stored beeper alerts remain dormant until the passenger chooses to activate them. The program can have many such alerts stored at once for different routes and stops.

By pressing in INFO key 106 once on the portable receiver 10 in FIG. 4, any stored messages will be displayed, starting with the first 36 characters of the first message. By subsequently pressing the up arrow key 104, the remainder of the message will page by, i.e., the next 36 characters will be displayed on the top and bottom displays 101 and 102. A repeat of this procedure will cause all of the message to be stepped through until the message has been completely displayed. If a second message was received, this message would now start to be displayed when the up arrow 104 was pressed again. That is, the up arrow 104 is used to step first through the body of a message, then to the next message, through the body of the second message, then to the third message, up to a total possible 64 stored messages. Any message will be erased by pressing the C (clear) key 113. If more than 64 messages are received, the oldest message, i.e. first received in the memory store of messages, would be erased and the memory space reused for a new incoming message.

By pressing the INFO key 106 rapidly twice on the portable receiver 10, any stored weather message will be displayed, starting with the first 36 characters of the weather message, which is the month, day and hour of the weather forecast. By subsequently pressing the up arrow key 104, the next 36 characters will be displayed on the top and bottom displays 101 and 102. A repeat of this procedure will cause the message to be stepped through, until the message has been completely displayed.

By pressing the FARE key 111 once, or by holding pressed any key on the keyboard of the portable receiver 10 for more than 1 second, causes the fare payment program to operate. This portable receiver program checks the internal RAM memory status of fare payment, as modified by the receipt of a fare payment file. If the status indicates that the portable receiver is a valid monthly, bi-weekly, week or day pass, then the message "VALID FARE" is blinked 3 times a second in the top display, for as long as hold up portable receiver 10, showing the operator that their fare has been paid.

By pressing the FARE key 111 quickly twice, the portable receiver 10 displays a Fare Payment File, showing the time of payment; type of payment authorization; and amount of authorization.

The foregoing is by example only, and the scope of the invention should be limited only by the appended claims.

The embodiments of the Invention in which an exclusive property or privilege is claimed are defined as follows:

1. An improved method of disseminating urban transit information relating to routes with a multiplicity of vehicles on them; said method utilizing the following elements:

an Automated Vehicle Location system;

a Transit Central Computer;

a computer data interface between the AVL and the TCC;

one or more radio broadcast towers;

a communications data interface between the TCC and the broadcast tower; and a multiplicity of portable radio receivers comprising visual readout, user input means, and computer memory and receiver computer programs;

said method comprising the following steps:

the TCC maintains a plurality of information files, herein called route files, concerning vehicle routes and schedules and users;

the AVL collects vehicle location information, herein called location files;

the TCC reads said location files from the AVL by means of the computer interface and combines location files with route files into three discrete data stream;

the three data streams are processed into radio broadcast data files, and forwarded to the broadcast tower by means of the communications interface; said three streams comprising:

first, a vehicle location file, containing vehicle location information; said file being transmitted periodically to said receivers;

second, a route information file, containing route information including stop numbers, route numbers, cross-streets, and route symmetry, and periodically transmitted to and maintained by the receivers in memory until updated; and third, a display information file, containing diverse information including weather information and warnings, personal messages, date and time, cross-street names, receiver identification, and prepaid fare validity, and periodically transmitted to said receivers;

the receivers having means for selective accessing the broadcast data files from one or more of said broadcast towers and utilizing said files in said receiver computer programs and processing means to compute values; and the receivers display information chosen from said values according to requests by users through the user input means, thus providing users with a visual readout of, at least, a continuously updated time-to-arrival estimate of the next arriving transit vehicle at a user-specified stop, with said estimate being counted down to zero, and corrected as new locational data is received by radio.

2. A method as in claim 1, in which the route files comprise at least information files on: route number; average vehicle speed; average weather; vehicle handicap status; vehicle loading; route symmetry; special entry of vehicles into route; special removal of vehicles from route; percentage behind schedule; weather warnings, personal messages, date and time, cross-street names, receiver identification, and prepaid fare validity.

3. A method as in claim 2, in which the information requested by users and displayed on the receivers includes: stop numbers; stop opposite information for a return transit trip; valid fare message; cross-street names; personal messages; and handicap status of transit vehicles.

4. A method as in claim 3, in which the location, route, and display files are each transmitted as a series of discrete records in 16-bytes using known computer coding techniques.

5. A method as in claim 4, in which the portable receivers comprise;

decoding means appropriate to decode said location, route and display files;

aural means; and wherein said user input means comprises keys or voice input means to activate said aural means.

6. A method as in claim 5, in which the visual display means comprises a first 18-character visual readout and a second 18-character visual readout.

7. A method as in claim 5, in which the user input means comprises keys including: "INFO" for information; "STOP#" for stop number; "BEEPER" for aural alert functions; "FARE" for prepaid fare validity information; numerals "0" through "9" for number entry; "ON/OFF" for power on/off; "T/B" for choosing top/bottom display; "C" for clear; "MEM" for memory functions; an up arrow to scroll through displays; and "ENTER" to enter user requests and data.

8. An improved apparatus for disseminating urban transit information relating to routes with a multiplicity of vehicles on them; said apparatus comprising:

an Automatic Vehicle Location (AVL) system providing real-time vehicle location data, herein called location files, of each transit vehicle on each route at least once each 1 1/12 minutes;

a Transit Central Computer (TCC) that maintains in its computer programs said real-time location information on each transit vehicle, and as well maintains other information files, herein called route information, comprising: route number; average vehicle speed; average weather; vehicle handicap status; vehicle loading; route symmetry; special entry of vehicles into route: special removal of vehicles from route; percentage behind schedule; weather warnings; personal messages; data and time;

cross-street names; receiver identification; and prepaid fare validity;

a computer data interface between the AVL and the TCC;

one or more radio broadcast towers;

a communications data interface between the TCC and the broadcast tower(s); and a multiplicity of portable radio receivers comprising visual readout, user input means, and computer memory and receiver computer programs;

whereby said TCC processes said location, route, time, and weather information into three discrete streams of radio broadcast data files, said files comprising:

first, a vehicle location file, containing (primarily) vehicle location information; said file being transmitted periodically to said receivers;

second, a route information file, containing (primarily) route information including stop numbers, route numbers, cross-streets, and route symmetry, and transmitted (daily) to and maintained by the receivers in memory until updated; and third, a display information file, containing diverse information including weather information and warnings, personal messages, date and time, cross-street names, receiver identification, and fare validity, and transmitted daily and more often as needed to said receivers; and forwards said files to a radio broadcast tower that broadcasts the files to the receivers;

whereby the receivers then utilize said files in said receiver computer programs and processing means to compute and display selected information, responsive to inputs to said user input means, including:

a visual readout of a continuously updated time-to-arrival estimate of the next arriving transmit vehicle at a user-specified stop, with said estimate being counted down to zero, and corrected as new locational data is received by radio; stop numbers; stop opposite information for a return transit trip; 'fare valid' message on the receiver in order to obtain access to transit vehicles; cross-street names; personal messages; and handicap status of transit vehicles; and further wherein said receivers include aural alert means selectively programmable by users to warn users of vehicles approaching specified stops at specified times.

9. An apparatus as in claim 8, in which the location, route, and display files are each transmitted as a series of discrete records in 16-bit bytes using known computer coding techniques.

10. An apparatus as in claim 9, in which the portable receivers comprise:

decoding means appropriate to decode said locations, route, and display files;

computer memory means to store said files;

computer programs means to compute and display said files;

visual display means to display the results of said computations; said display means comprising a first 18-character visual readout and a second 18-character visual readout;

a programmable beeper alert; and user input means such as keys or voice input.

11. An apparatus as in claim 10, in which the user input means comprises keys including: "INFO" for information; "STOP#" for stop number; "BEEPER" for aural alert functions; "FARE" for prepaid fare validity information; numerals "0" through "9" for number entry; "ON/OFF" for power on/off; "T/B" for choosing top/bottom display; "C" for clear; "MEM" for memory functions; an up arrow to scroll through displays; and "ENTER" to enter user requests and data.

12. An apparatus providing transit users with continuously updated arrival time estimates of next vehicle arrivals at any one of a plurality of specific vehicle stops on routes having a multiplicity of vehicles on them; said apparatus comprising:

data interface to an Automatic Vehicle Location (AVL) system; said AVL system providing real-time vehicle location data of each transit vehicle on each route at least once each 1½ minutes, to a Transit Central Computer (TCC);

a TCC that maintains in its computer programs said real-time location information on each transit vehicle, and as well maintains route information and time information; and weather information; vehicle handicap status; vehicle loading; route symmetry; special entry of vehicles into route; special removal of vehicles from route; and percentage speed slower than average;

one or more radio broadcast towers; and a multiplicity of portable radio receivers comprising visual readout, user input means, and computer memory and receiver computer programs;

said TCC having means for processing said location, route and time information into radio broadcast data files, and forwarding selected files to said one or more radio broadcast towers for broadcasting the files to the receivers;

microprocessing means in each receiver for selectively accessing the files broadcast from said one or more radio broadcast towers and to compute and display selected information, thus providing users with a visual readout of a continuously updated time-to-arrival estimate of the next arriving transit vehicle at a user-specified stop, with said estimate being counted down to zero, and corrected as new locational data is received by radio.

13. An apparatus as in claim 12, in which the TCC processes and periodically transmits information in three discrete files; said files comprising:

first, a vehicle location file, containing vehicle location information;

second, a route information file, containing route information including stop numbers, route numbers, cross-streets, and route symmetry; and third, a display information file, containing diverse information including weather information and warnings, personal messages, date and time, cross-street names, receiver identification, and prepaid fare validity.

14. An apparatus as in claim 13, in which users enter route and stop number into a portable receiver and obtain stop opposite information for a return transit trip.

15. An apparatus as in claim 13, in which users display a valid fare message on the receiver in order to obtain access to transit vehicles.

16. An apparatus as in claim 13, in which the receiver has programmable aural alert means and optionally displays data on handicap status of transit vehicles.

17. The method of claim 1 wherein said receivers include a programmable aural alert means and wherein said method includes said user selectively programming said aural alert means to warn users of vehicles approaching specified stops at specified times.

* * * * *